US009772155B2

(12) United States Patent
Schechter

(10) Patent No.: US 9,772,155 B2
(45) Date of Patent: Sep. 26, 2017

(54) SYSTEM, DEVICE AND METHOD FOR THE PREVENTION OF FRIENDLY FIRE INCIDENTS

(71) Applicant: ALFA YUTA, PROMPTING, DEVELOMPMENT AND ADVANCED TECHNOLOGY LTD, Zipori (IL)

(72) Inventor: Amir Schechter, Kadima (IL)

(73) Assignee: SAFESHOOT LTD, Zipori (IL)

( * ) Notice: Subject to any disclaimer, the term of this patent is extended or adjusted under 35 U.S.C. 154(b) by 0 days.

(21) Appl. No.: 14/767,929

(22) PCT Filed: Oct. 24, 2014

(86) PCT No.: PCT/IL2014/050925
§ 371 (c)(1),
(2) Date: Aug. 14, 2015

(87) PCT Pub. No.: WO2015/059708
PCT Pub. Date: Apr. 30, 2015

(65) Prior Publication Data

US 2016/0223278 A1 Aug. 4, 2016

(30) Foreign Application Priority Data

Oct. 24, 2013 (IL) ..... 229078

(51) Int. Cl.
*F41A 17/08* (2006.01)
*F41A 17/06* (2006.01)

(52) U.S. Cl.
CPC ..... *F41A 17/08* (2013.01); *F41A 17/063* (2013.01)

(58) Field of Classification Search
CPC ..... F41A 17/00; F41A 17/063; F41A 17/08
USPC ..... 89/1.11; 42/70.01, 70.04, 70.05, 70.06, 42/70.07, 70.08, 70.09, 70.11; 235/400, 235/404, 407, 411, 413, 414, 417
See application file for complete search history.

(56) References Cited

U.S. PATENT DOCUMENTS 5,822,713 A * 10/1998 Profeta ..... F41G 3/02 342/67
8,739,672 B1 * 6/2014 Kelly ..... F41G 3/02 89/1.11
8,887,566 B1 * 11/2014 Tanenhaus ..... G01C 21/165 702/145
2004/0005532 A1 * 1/2004 Schmedemann ..... F41G 3/26 434/11
2005/0115386 A1 * 6/2005 LaFata ..... F41A 17/08 89/1.11
2014/0230296 A1 * 8/2014 Kuparinen ..... F41A 17/063 42/1.01
2015/0198399 A1 * 7/2015 Goren ..... F41A 17/063 42/70.11

* cited by examiner

*Primary Examiner* — Bret Hayes
(74) *Attorney, Agent, or Firm* — The Law Office of Joseph L. Felber

(57) ABSTRACT

A friendly fire avoidance system the system that is implemented in any arena involving weaponry and people, such as hunting, policing, military, emergency services, the system using a plurality of specialized navigation and communication devices 'NCD', that are wirelessly associated with one another and in communication with one another forming a MESH network, each NCD utilized in the system is associated with a friendly asset.

46 Claims, 9 Drawing Sheets

SYSTEM, DEVICE AND METHOD FOR THE PREVENTION OF FRIENDLY FIRE INCIDENTS

This Application is a national phase of, and claims priority from, PCT Application No. PCT/IB2014/050925, filed on Oct. 24, 2014, which claims priority from Israeli Application No. 229078, filed Oct. 24, 2013, which is hereby incorporated by reference as if fully set forth herein.

FIELD OF THE INVENTION

The present invention relates generally to weapons systems and, more specifically, to a friendly fire avoidance system implemented in any arena involving weaponry and people.

BACKGROUND OF THE INVENTION

Casualties due to "friendly fire" have been an unfortunate element of warfare throughout history. Friendly fire refers to incidents in which forces accidentally fire on their own or non-enemy forces causing unnecessary casualties and fatalities. Incidents of friendly fire weather on the battlefield, during a hunting expedition, or while using any form weaponry systems is perhaps considered the most tragic form of a casualty.

Furthermore such friendly fire incidents may also lead to non-human heavy losses in the form of warring assets such as tanks and helicopters, or the like.

Instances of friendly fire often involve aircraft and/or helicopters mistakenly firing on their own ground troops. In addition, such incidents often occur at night when visibility is poor. Similarly friendly fire may occur between larger assets such as tanks and/or ships or battle ready vehicle in various situations.

Despite the development of various systems to try to minimize the number of such incidents, they unfortunately continue to occur.

SUMMARY OF THE INVENTION

Therefore, there exists an unmet need for a system, device and method that incorporates a plurality of sensors and navigation tools to provide for identifying friendly forces, and/or assets so as to prevent unintentional cross fire between friendly forces and/or assets either in civilian and/or military environments respectively.

Embodiments of the present invention provide for preventing cross-fire and/or friendly fire between friendly forces in a military environment or a civilian environment. For example embodiments of the present invention may provide for preventing friendly fire in a military environment between two ground forces units that are active in the same area. For example, embodiments of the present invention may provide for preventing friendly fire between different types or forms of friendly assets that are collaborating in a battle such as naval units, air force, ground forces, or the like. For example such system may be implemented to prevent a friendly air-force assets and/or navel-force assets from firing on friendly ground unit forces.

Embodiments of the present invention provide for preventing cross-fire and/or friendly fire between friendly forces in a civilian environment, such as a hunting expedition. For example embodiments of the present invention may provide for preventing friendly fire between two hunters in a hunting expedition that are active in the same general area.

An optional embodiment of the present invention provides a system for preventing friendly fire between different friendly assets by associating every asset and individual with a navigation and communication device (NCD) according to the present invention. Preferably the navigation and communication device is customized to the type of asset associated therewith, for example including but not limited to a weapon, an individual, a vehicle, an animals (for example including but not limited to hunting dogs, military dogs) that may be involved in a battle field and/or a hunting setting.

Optionally at least two or more NCDs may be configured to be in direct and/or indirect (relayed) communication with one another.

Optionally the interaction between a plurality of navigation and communication device (NCD) according to the present invention may be controlled and/or governed and/or overseen with at least one or more remote processing center and/or server and/or an administrator server and/or microcontroller, or the like.

Most preferably a plurality of navigation and communication devices associated with individual friendly assets may be in communication with one another by way of a self-organized MESH network, wherein each friendly asset is a member and/or node forming the network. Most preferably the MESH network may be utilized to communicate and map the location, position, and direction of aim of all friendly assets and forces within ballistic range of one another.

Optionally the size and number of members forming a self-organized MESH network may be based on at least the direction of aim of all friendly assets and more preferably further based on the location and position of each member and/or node relative to other nodes and/or network members.

Optionally and preferably each navigation and communication device may create and/or organize its own local MESH network centered around the direction of aim, the device's location, position, its potential firepower range, its firepower ballistic capabilities.

Optionally, a single global MESH networks may be defined to include all friendly assets within a defined geographical area for example a single battlefield and/or combat arena. Optionally, a plurality of MESH networks may be defined within a single battlefield or warring arena. Optionally a single global MESH network may be defined to include a plurality of local MESH networks.

Optionally and most preferably the MESH network is continuously adjusted to include and/or remove network members based on the direction of aim, the device's location, device's position, its potential firepower range, its firepower ballistic capabilities, ammunition trajectory, any combination thereof or the like.

Optionally a MESH network formed with the NCD (navigation and communication device) may be allotted a corresponding remote administrator. Optionally the MESH network architecture formed is paralleled with the number administrators allotted. For example, a global MESH network comprises a corresponding global administrator and individual local MESH networks comprises corresponding local administrator.

An optional embodiment of the present invention comprises a navigation and communication device comprising a controller and memory module, a mobile power supply, a communication module, a GPS module, Radio Frequency (RF) module, Optics Module, and a sensor module.

Optionally communication module may provide for encoding and/or encrypting communication transmitted and/or received via the communication module and/or any module capable of communication.

Optionally the navigation and communication device may be rendered functional as an independent unit that is associated with an optional friendly asset for example a soldier, animal, weapon or the like.

Optionally the navigation and communication device may be rendered functional when coupled or otherwise functionally associated with existing friendly assets such as processing units and/or weapons processing units for example including but not limited to ballistics and/or weapons processing units provided in aircrafts, fighter jets, helicopters, tanks, war ships, or the like.

Most preferably the sensor module includes a three-axis digital compass, a three-axis gyro sensor, and a three-axis accelerometer. Preferably the sensor module further comprises barometric pressure sensor. Optionally and preferably the sensor module facilitates determining a weapon's direction of aim, range, ballistics, trajectory, any combination thereof or the like. Optionally the sensor module may be coupled and/or associated with the barrel or firing barrel of a weapons and/or the weaponry processing unit of a friendly asset.

Optionally a three-axis digital compass may be realized in the form of a magnetic field sensor. Most preferably a three axis digital compass provides for magnetic field sensing.

Optionally the sensor module may provide and/or facilitate determining the directionality of a weapon's barrel and/or weapons processor and/or ballistic processor to determine the general direction of aim.

Optionally and preferably the sensor module may further provide and/or facilitate navigation when GPS reception is low and/or not available.

Optionally the sensor module may further comprise temperature sensor, luminosity sensor, digital light sensor, heart rate sensor, flow-meter, pulse oximeter, piezoelectric pressure sensor, pressure sensor, any combination thereof or the like.

Optionally the navigation and communication device may further comprise an energy harvesting module provided to convert kinetic energy into electric energy.

Optionally the navigation and communication device may be configured to have optional functional communication modes for communicating with other NCDs and/or administrators. Optionally the communication mode may for example including but not limited "always on", "always receiving", always transmitting, intermittent, controlled receiving time, controlled transmitting time, any combination thereof or the like.

For example, in the "always on" mode the device may always be communicating both receiving and transmitting. For example, the device is continuously scanning for friendly fire threat while communicating a beacon to nearby devices. Optionally the communication device may be provided in an "always listen mode" and/or in an "always transmit mode", or any combination thereof.

Optionally the navigation and communication device may be configured to be in an "intermittent mode" wherein the device communicates at controllable intervals. Optionally the intervals may be determined and/or controlled by a user and/or the processing module, and/or a fixed time frame and/or a sensed occurrence and/or occurrence/event and/or threat or any combination thereof. For example, the device may ping and/or beacon other devices to listen to a response at a controllable time interval such as every 15 minutes or similarly every 15 seconds. For example, a user may elect to ping the device at a given time interval.

An optional embodiment of the present invention provides a friendly fire avoidance system, the system comprising a weapons unit and an executing unit, each of the unit individually including a controller and memory module, mobile power supply, communication module, GPS module, Radio Frequency (RF) module, Optics Module and a sensor module, characterized in that the sensor module comprises a three-axis digital compass, three-axis gyro sensor, and a three-axis accelerometer; wherein the controller module controls and integrates the functionality of the weapons unit and the executing unit, and wherein the communication module provides for transmitting and receiving signals from associated weapons unit and/or executing unit associated therewith in a MESH network wherein each of the weapons unit and the executing unit form a member and/or node of the MESH network;

Wherein the weapons unit may be associated with a weapon and/or firearm having a barrel the weapons unit characterized in that its RF module includes a narrow beam antenna provided to identify the direction of aim of the firearm and/or weapon; and wherein the processor comprises a priori data relating to the weapon associated with the weapon's unit, for example including but not limited to associated ammunition, ammunition trajectory, and ammunition range provided for estimating the hit zone specific to the type of weapon and ammunition utilized; and Wherein the executing unit may be associated with at least one of a soldier, animal, battlefront vehicle; the executing unit characterized in that the RF module includes a wide beam antenna and wherein the controller comprises a priori data relating to performance of executing unit coupled thereto.

Optionally the executing unit may comprise an optics module that includes a photo-detector. Optionally the photo-detector may be positioned parallel to the RF module.

Optionally the executing unit may be associated with an article of clothing. Optionally the article of clothing may be provided in the form of footwear. Optionally the article of clothing may be provided in the form of a wearable items selected from the group consisting of a vest, hunting vest, collar and bracelet, gloves, the like or any combination thereof.

Optionally the executing unit further comprises an energy harvesting module that may be associated with footwear to generate energy with each step taken with the footwear.

Optionally the weapons unit and the executing unit by default are in an "always on" mode.

Optionally the weapons unit and the executing unit may be manually deactivated (turned off) for a preset period of time. Optionally the weapons unit and the executing unit may be manually deactivated (turned off) for a preset number of times within a given timespan.

Optionally a plurality of weapons unit and a plurality of execution units may be in communication with one another forming a MESH network. Optionally the MESH network may be a self-organized and/or moving MESH network wherein new members (nodes) may be recruited and/or included based on their proximity to an existing member, wherein each network member and/or nodes is an NCD in the form of a weapons unit and/or an executing unit.

Optionally the MESH network may be a self-organized and/or moving MESH network wherein new members (nodes), in the form of optional NCDs, may be recruited and/or included if it may be in ammunition range and/or a weapon may be pointed in its direction.

Optionally each of the NCD controller modules defines a risk area.

Optionally the NCD controllers; define a non-firing zone.

Optionally the NCD controllers' define a firing safe zone.

Optionally the NCD for example at least one of the weapons unit or the executing unit may further comprise a User Interface (UI) module.

Optionally the UI module may be for example include but is not limited to at least one or more of keyboard, display, touch screen, touch pad, buzzer, tactile pad, at least one light emitting diode (LED), at least one organic LED (OLED), speakers, microphone, the like or any combination thereof.

Optionally the battlefront vehicle may for example include but is not limited to at least one of armored vehicles, infantry vehicles, combat vehicles, tanks, naval vessels, warships, submarines, air force vehicles, fighter jets, airplanes, helicopter gunship, unmanned aerial vehicle (UAV), drones, or the like.

Optionally the weapon may be a manually triggered firearm of any caliber and/or size, for example including but not limited to at least one of a hand held gun, gun, pistol, rifle, assault weapon, assault rifle, automatic weapon, semi-automatic weapon, machine gun, RPG, MAG, launcher, grenade launcher, mortar cannon, mortar launcher, cannon, tank cannon, artillery launcher, howitzer, or the like.

Optionally the system comprising a plurality of NCD's may further comprise a higher processing center in the form of an administrator in the form of a processing unit, preferably provided to oversee management and interaction of the NCD units for example in the form of a weapons unit and/or an executing unit. Optionally the administrator may remotely control an NCD for example the weapons unit and/or the executing unit. Optionally the administrator may remotely control an NCD, for example the administrator may shut-down and/or disable at least one or more of the NCD's forming the system for example including a weapons unit and/or an executing unit.

Optionally the administrator may remotely define and incorporate a MESH network member in the form of NCD's for example including but not limited to a weapons unit and/or an executing unit. Optionally the administrator may remotely define the MESH network members.

Optionally the administrator may be provided with master control of all MESH network members.

Optionally the sensor module may further comprise a barometric pressure sensor.

Optionally the weapons unit may further comprise a disarming module that may be functionally associated with the weapon along its trigger provided to disable firing the weapon. Optionally the weapon may be disabled remotely for a preset period of time. Optionally the weapon may be disabled remotely for a limited period of time.

An optional embodiment of the present invention provides a Navigation and Communication Device ('NCD') device including a controller module, mobile power supply, communication module, UI module, GPS module, Radio Frequency (RF) module, Optics Module and a sensor module, characterized in that the sensor module comprises a three-axis digital compass, three-axis gyro sensor, and a three-axis accelerometer.

Optionally a three-axis digital compass may be realized in the form of a magnetic field sensor.

Optionally the sensor module may further comprise a barometric pressure sensor.

Optionally the RF module may comprise an RF antenna that may for example include but is not limited to at least one or more antenna selected from a narrow beam antenna, a wide beam antenna, an omnidirectional antenna, a directional antenna, a polarizing antenna, the like or any combination thereof.

Optionally the user interface (UI) module may for example include but is not limited to at least one of a keyboard, display, touch screen, touch pad, buzzer, tactile pad, at least one light emitting diode (LED), at least one organic LED (OLED), speakers, microphone or any combination thereof.

Optionally the NCD may be configured to be a hand held mobile device.

Optionally the NCD may be configured to be integrated with an article of clothing. Optionally the NCD may be configured to be integrated with footwear. Optionally the NCD may be provided in the form of an article of clothing that may be provided in the form of a wearable item for example including but not limited to at least one of a collar, a bracelet, glove, a vest, the like or any combination thereof.

Within the context of this application the term ' navigation and communication device' may be interchangeably referred to as NCD. Optionally NCD may be customized and referred to as a weapons unit, executing unit or the like.

Within the context of this application the term "friendly assets" refers to any friendly forces assets and/or ally asset that one wishes to maintain and/or protect. Optionally assets that may be utilized, may for example include but is not limited to human assets, soldiers, animal assets, robotic assets, mobile assets, stationary assets, weaponry, vehicles, tanks, naval ships, battleships, warship carrier, gunships, airborne assets, fighter jets, drones, helicopters, weapons, personnel carrier, vehicles, airplanes, ammunition, ballistic assets, missiles, rockets, the like or any combination thereof.

Within the context of this application the term "weapons unit" is to refer to an optional navigation and communication device according to an optional embodiment of the present invention that is configured and/or customized and/or adapted to be coupled or otherwise associated with a weapon and/or firearm of choice. Optionally a weapon may refer to any weapon for example including but not limited to hand held gun, pistol, gun, rifle, assault weapon, assault rifle, shotgun, automatic weapon, semi-automatic weapon, machine gun, long range hand held gun, sniper gun, rocket launcher, shoulder fired missile weapon, rocket propelled grenade ('RPG'), a general purpose machinegun ('MAG'), launcher, grenade launcher, mortar cannon, mortar launcher, cannon, tank cannon, artillery launcher, howitzer, robot, or the like.

Within the context of this application the term "executing unit" or "execution unit" is to refer to an optional navigation and communication device according to an optional embodiment of the present invention that is configured and/or customized and/or adapted to be coupled and/or otherwise associated with a an individual, person, soldier, robot, animal, battlefront asset, battlefront vehicle or the like. Optionally a battlefront asset and/or vehicle may for example include but not limited to armored vehicles, infantry vehicles, combat vehicles, tanks, naval vessels, warships, submarines, air force vehicles, fighter jets, airplanes, helicopter gunship, unmanned aerial vehicle (UAV), drones, terrestrial robots, airborne robots, marine robots, naval robots or the like.

Unless otherwise defined the various embodiment of the present invention may be provided to an end user in a plurality of formats, platforms, and may be outputted to at least one of a computer readable memory, a computer display device, and a printout, a computer on a network or a user.

Unless otherwise defined, all technical and scientific terms used herein have the same meaning as commonly understood by one of ordinary skill in the art to which this invention belongs. The materials, methods, and examples provided herein are illustrative only and not intended to be limiting.

Implementation of the method and system of the present invention involves performing or completing certain selected tasks or steps manually, automatically, or a combination thereof. Moreover, according to actual instrumentation and equipment of preferred embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a plurality of software instructions being executed by a computer using any suitable operating system. In any case, selected steps of the method and system of the invention could be described as being performed by a data processor, such as a computing platform for executing a plurality of instructions.

Although the present invention is described with regard to a "computer" on a "computer network", it should be noted that optionally any device featuring a data processor and/or the ability to execute one or more instructions may be described as a computer, including but not limited to a PC (personal computer), a server, a minicomputer, a cellular telephone, a smart phone, a PDA (personal data assistant), a pager. Any two or more of such devices in communication with each other, and/or any computer in communication with any other computer may optionally comprise a "computer network".

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

The principles and operation of the present invention may be better understood with reference to the drawings and the accompanying description.

The following figure reference labels are used throughout the description to refer to similarly functioning components are used throughout the specification hereinbelow.

Figure 1:
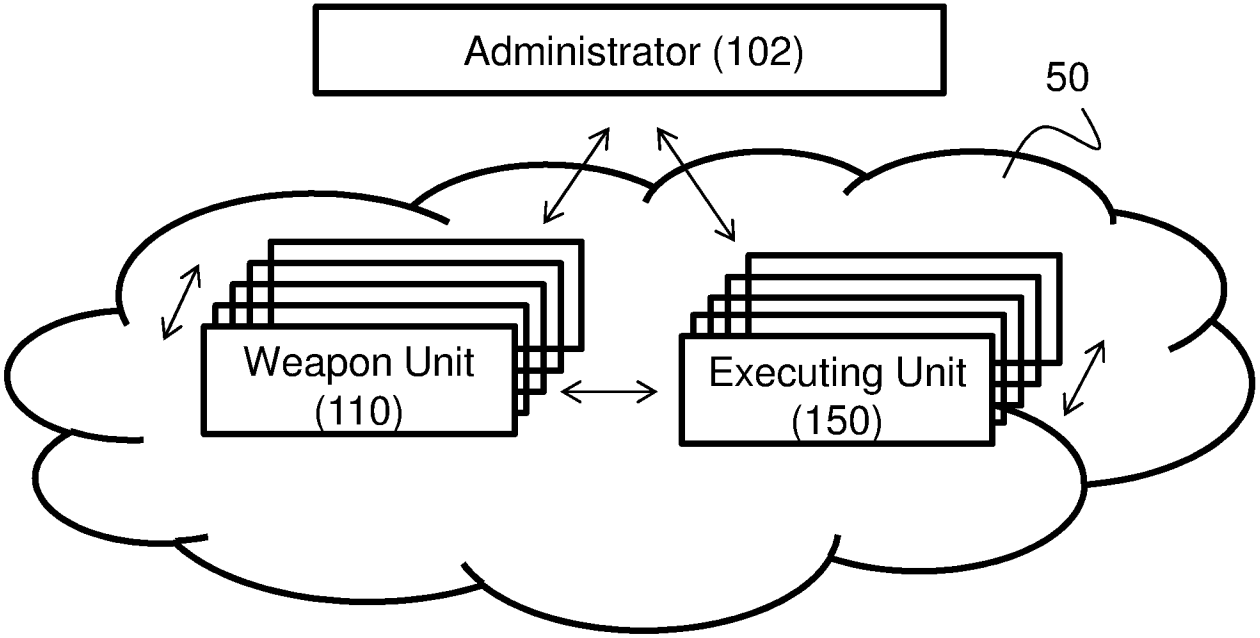
FIG. 1 is a schematic block diagram of an exemplary system according to the present invention.

10 firearm/weapon;
12 barrel;
20 soldier;
22 animal;
30 battlefront vehicle;
50 Global MESH network;
52 Local MESH network;
54 a firing safe zone;
56 non-firing zone;
100, 700 friendly fire avoidance system;
102, 702 administrator;
110, 710 weapons unit;
140 disarming module;
150 executing unit;
202,152,112 controller and memory module;
204,154,114 power supply;
210,155,115 UI module;
206,156,116 communication module;
208,158,118 GPS module;
212,160,120 Radio Frequency RF module;
214,164,124 Optics Module;
220,170,130 sensor module;
222,172,132 three-axis gyro sensor;
224,174,134 three-axis accelerometer
226,176,136 three-axis digital compass;
228,178,138 barometric pressure sensor;
122 a narrow beam antenna;
162 wide beam antenna;
166 a photo-detector;
200 Navigation and communication device;
705 Hunting Mesh Network;
750 Hunting Unit;
752 Animal Unit;

FIG. 1 shows a schematic block diagram of an exemplary system 100 according to the present invention for preventing a friendly fire incident, in any situation be it military or policing areas for example a battle zone, war zone, military exercise zone, active crime scene, or a civilian for example on hunting grounds, or the like arena where a friendly firepower assets are distributed in a given area, therein giving rise to a potential for a friendly fire incident. System 100 comprises a plurality of o navigation and communication devices (NCD) 200 (FIG. 4) that are in communication with one another. As shown here a policing and/or military embodiment of the NCD 200 may be utilized in two optional forms for example provided in the forms a weapons unit 110 and an executing unit 150, that are in communication with one another. Optionally and preferably NCD unit 110,150 may utilize a plurality of technological modules for facilitating prevention of friendly fire incidents, for example within the military and/or policing arena. Preferably NCD units 110, 150 include plurality of technological modules for example including but not limited to: wireless communication in the form of Radio Frequency ('RF), optical for example in the form of laser, satellite communication in the form of Global Positioning System ('GPS'), or the like.

Most preferably NCD units 110, 150 are independent devices that can function either independently or interactively in a network setting.

The weapons unit 110 is a specialized configuration of NCD unit 200 (FIG. 4) provided for associating with a weapon. The execution unit is a specialized form of an NCD unit 200 provided for associating with an executing unit for example including but not limited to an individual, person, soldier, police person, robot, animal, battlefront asset, battlefront vehicle or the like.

Optionally and preferably the executing unit 150 is associated with an asset capable of controlling the weapons with which the weapons unit 110 is associated.

Most preferably the plurality of NCD forming system 100 for example in the form of, weapons unit 110 and executing unit 150 may form a self-organizing MESH network 50 that allows each executing unit 150 and/or weapons unit 110 to be in communication with one another.

Optionally communication between NCD units 110, 150 may be realized as direct communication or indirect (relayed) communication. Optionally during direct communication at least two or more units 110,150 are wirelessly associated with one another and capable of exchanging data. Optionally during indirect communication at least three or more units 110,150 are wirelessly associated with one another and capable of exchanging data where at least one unit 110,150 acts a communication relay station to relay communication between at least two units 110, 150.

Optionally and preferably system 100 may comprise a system administrator 102 that may be provided to depict the overall friendly asset distribution. Optionally administrator 102 may be provided as a higher processing center that is in communication with all friendly assets associated with a weapons unit 110 and/or an executing unit 150. Optionally administrator 102 is a server or the like computer or processor capable of providing an overall depiction of friendly assets that are deployed and may optionally provide a graphical display or rendering of the deployed assets.

Optionally communication between administrator 102 and friendly assets associated with units 110, 150 may be facilitated using communication modules disposed therein utilizing communication by any contactless, and/or wireless communication protocol as is known in the art, for example including but not limited to cellular communication.

As shown in FIG. 1 the directional arrows depict the various communication possibilities provided by system 100, wherein individual members forming system 100 may be in communication with one another. For example a plurality of weapons unit 110 may be in communication with one another. For example a plurality of executing units 150 may be in communication with one another. For example, any number of weapons unit 110 and executing units 150 may be in communication with one another. Similarly administrator 102 may be in communication with one or more NCD in the form of units 110, 150 within MESH network 50.

Optionally administrator module 102 may be realized as a hierarchal network of computers including a master administrator and a plurality of slave administrators that report into the master administrator. Optionally individual slave administrators may be associated with a subset of the overall friendly assets. Optionally a plurality of slave administrators may collectively provide for depicting the overall situation that may be analyzed and/or displayed by a master administrator unit.

Optionally and preferably administrator module 102 may communicate with units 150,110 in a two way manner allowing an administrator 102, slave or master, to optionally disarm and/or disable any friendly asset associated therewith, for example by communicating a disable and/or disarm signal.

Optionally and preferably a communication history between friendly assets may be maintained to provide for continuously updating and evaluating the probability of friendly fire between at least two friendly assets. Optionally the communication history may be further provided with administrator 102.

Figure 2A:
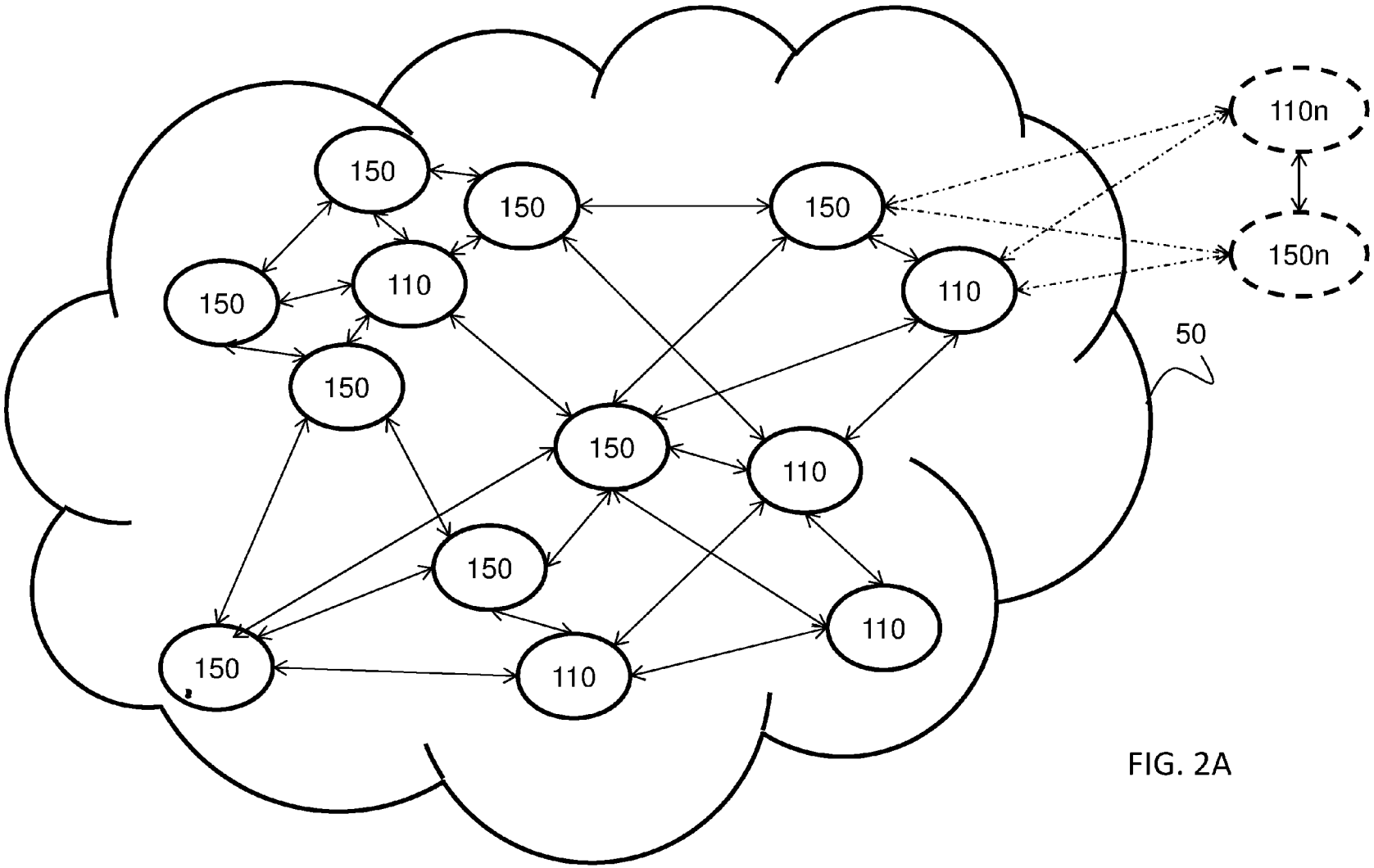
FIG. 2A-B are schematic illustrative diagram of an exemplary system according to the present invention showing optional MESH networks realized with the system of the present invention.

FIG. 2A shows an optional MESH network 50, depicted in the form of a global MESH network, comprising a plurality of specialized navigation and communication devices that are associated with friendly forces and assets in the form of execution unit 150 and/or weapons unit 110, wherein each unit 110,150 forms a node and/or a single member of MESH network 50.

Optionally and preferably the global MESH network 50 is a self-organized network. Optionally MESH network 50 is readily adjustable to receive new members 110*n*, 115*n*, for example as shown.

Most preferably MESH network 50 is defined based on the proximity of a friendly asset associated with units 110,150. Most preferably any friendly assets that are in ballistic range of neighboring members are included in the MESH network 50. For example as shown, in FIG. 2A-2B, units 110*n* and 150*n* will be included in MESH network 50 if and/or when they fall within ballistic range of any of the neighboring units.

Most preferably each node and/or member network 50 is autonomous and may be rendered functional without collaborating with an administrator 102, slave NCD or master NCD.

Figure 2B:
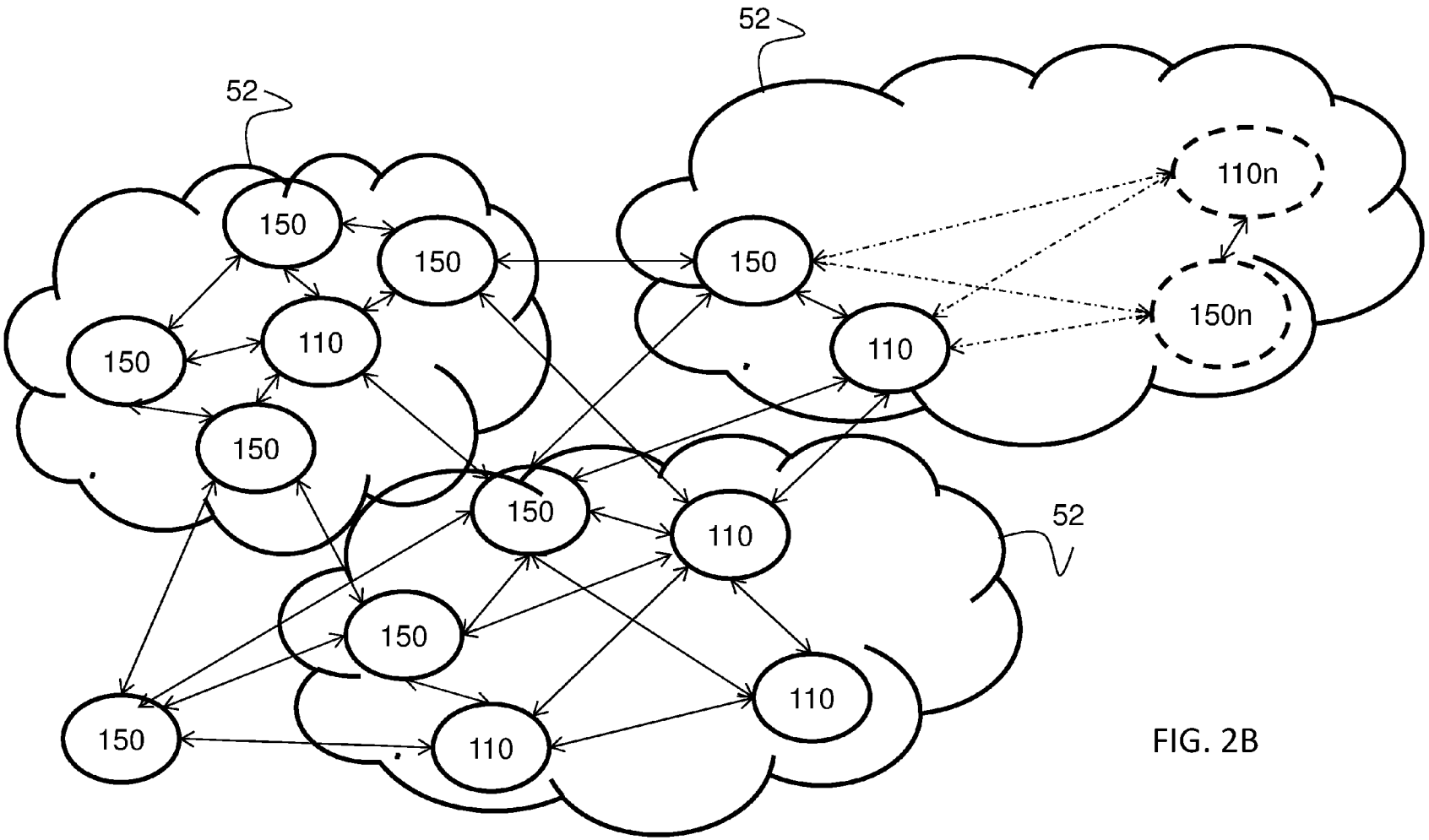

FIG. 2B shows the same friendly asset distribution as shown in FIG. 2A, however having a self-generating MESH network comprising a plurality of local MESH network 52. Optionally the MESH network configuration may be depicted by an administrator 102 (not shown). Optionally the local MESH network 52 configuration may be implemented based on statistical analysis that depicts an areas and/or a plurality of members 110, 150 that are at an increased likelihood and/or risk for being involved in a friendly fire incident. Optionally the MESH network 50,52 may be formed in a particular configuration due to terrain limitation and/or communication limitation. For example, a MESH network 52 may be set up to include a third friendly asset to act as a relay station between a first and second friendly asset, regardless if any friendly fire threat is posed to the third asset.

Optionally the statistical analysis identifying neighboring friendly assets that pose a risk for friendly fire incidents is optionally and preferably performed by a processing module 112, 152 provided in individual members 110, 150 respectively. Optionally the statistical analysis may be provided and/or adjusted by an administrator 102.

Most preferably system 100 prevents friendly fire by continuous and seamless communication between deployed friendly assets associated with units 110,150. Most preferably communication between neighboring friendly assets utilizing units 110,150 allows for a multilayered communication and data sharing reflecting the location and line of fire and/or direction of aim of all deployed friendly assets.

Figure 3A:
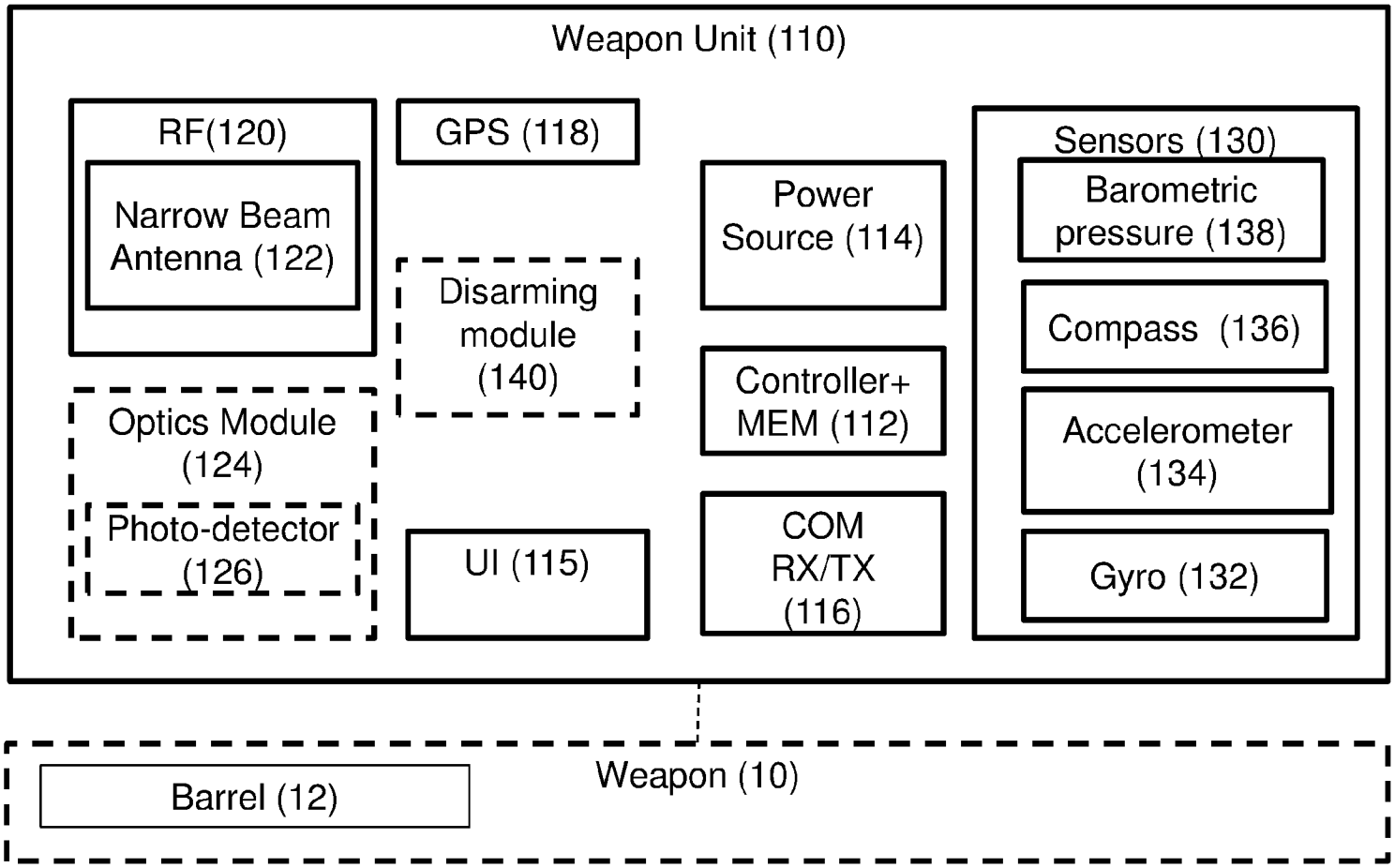
FIG. 3A is a schematic block diagram of an exemplary weapons unit device according to an optional embodiment of the present invention.

FIG. 3A shows a schematic block diagram of an optional embodiment of a navigation and communication device 200 (FIG. 4) that is customized to form weapons unit 110. Most preferably weapons unit 110 is customized such that it is functionally associated with optional firearms and/or weapon 10. Most preferably weapons unit 110 is characterized in that it is capable of determining and communicating data relative to neighboring assets. Most preferably weapons unit 110 provides for identifying and communicating the firing line formed with weapon 10 and/or the direction of aim of the particular firearm and/or weapon 10.

Weapons unit 110 may be coupled and/or functionally associated with a plurality of optional weapons 10 for example including but not limited to a hand held gun, gun, pistol, rifle, assault weapon, assault rifle, shotgun, automatic weapon, semi-automatic weapon, machine gun, long range hand held gun, sniper gun, rocket launcher, shoulder fired missile weapon, rocket propelled grenade ('RPG'), a general purpose machinegun ('MAG'), launcher, grenade launcher, mortar cannon, mortar launcher, cannon, artillery launcher, howitzer, robot, tank cannon, or the like.

Weapons unit 110 comprises a controller and memory module 112, a mobile power supply 114, user interface (UI) module 115, a communication module 116, a GPS module 118, Radio Frequency (RF) module 120, and a sensor module 130. Optionally weapons unit 110 may further comprise Optics Module 124.

Most preferably the sensor module 130 includes a three-axis digital compass, a three-axis gyro sensor, and a three-axis accelerometer. Optionally and preferably the sensor module may further comprise barometric pressure sensor.

Optionally the three-axis digital compass may be realized in the form of a magnetic field sensor.

Weapons unit 110 is preferably adapted to fit with and associate with any weapon. Optionally and preferably at least a portion of weapons unit 110 is associated with weapon 10 for example along weapon 10 barrel 12.

Optionally weapon's unit 110 may further comprise a disarming module 140. Optionally disarming module 140 may be coupled or otherwise associated to a trigger and/or the like triggering activator and/or triggering mechanism. Optionally disarming module 140 may be controlled remotely for example with administrator 102.

Controller and memory module 112 provides for storing and processing data associated with unit 110. Optionally and preferably controller and memory module 112 provides for ascertaining likelihood and/or probability of friendly fire with respect to nearby friendly assets that are associated with NCD units 110, 150.

Mobile power supply 114 may be provided in the form of a rechargeable battery. Optionally power supply 114 may be further associated with an energy harvesting device for example including but not limited to a piezoelectric pressure pad, solar cells, any combination thereof or the like.

Optionally, UI module 115 provides a user with means for interfacing with processor and memory module 112 may be provided in optional forms for example including but not limited to keyboard, display, touch screen, touch pad, buzzer, tactile pad, at least one light emitting diode (LED), at least one organic LED (OLED), speakers, microphone or any combination thereof. Optionally UI module 115 may indicate to a user when weapon is activated and there is minimal risk for friendly fire.

Optionally communication module 116 provides for communicating with other friendly assets associated with an NCD according to embodiments of the present invention utilized to form system 100 and/or an optional administrator 102, for example including but not limited to other weapons unit 110, executing units 150, NCD 200, weapons unit 710, animal unit 752, hunting unit 750, administrator 702, any combination thereof or the like. Optionally communication module may be realized in the form of a receiver transceiver (Rx/Tx) able to both receive and transmit communication signals. Optionally and preferably communication module 116 is functionally associated with all communication means incorporated with weapons unit 110, for example including but not limited to RF module 120, optics module 124, GPS 118 therein preferably providing unit 115 with a plurality of optional forms of communications.

Optionally and preferably GPS module 118 provides a navigation and location device implemented as is known in the art.

Optionally a Radio Frequency (RF) module 120 facilitates RF communications with communication module 116. Most preferably RF module 120 disposed on a weapons unit 110 is characterized in that it is provided with a narrow beam antenna 122 to facilitate transmission of a directional RF signal. Narrow beam antenna 122 is positioned insubstantially in parallel to the barrel 12 of the weapon 10 associated with weapons unit 110. Optionally narrow beam antenna 122 is configured to produce a narrow RF signal and/or beam in the direction of the barrel 12, therein reflective of the associated weapon's direction of aim.

Accordingly RF module 120 and antenna 122 provide for generating and transmitting a RF signal that is parallel to the barrel of a weapon therein providing an indication of the direction of aim of weapon 10 and/or barrel 12. Most preferably the directional RF signal is communicated to friendly assets forming part of system 100 most preferably coupled with ammunition data and ballistic data from said controller module 112. Most preferably any friendly asset that is in both in the direction of aim and within ballistic range is provided with the necessary information.

Optionally narrow beam antenna 122 disposed in said RF module 120 is selected and/or is configured according to the type of barrel 12 and/or weapon 10 it is associated with so that antenna 122 parallels the performance characteristics of the barrel 12 and/or weapon 10 attached thereto. For example, the characteristics and performance capability of narrow beam antenna 122 is selected according to the weapon it is associated with. For example the antenna 122 fit with a tank is configured so as to reflect the tank's cannon's performance for example trajectory, scope, range or the like. For example antenna 122 that is fit over a gun and/or rifle for example an 'M16' rifle is configured so as to reflect the rifle's barrel and expected performance for example including but not limited to trajectory, scope, range or the like.

Optics module 124 preferably provides for generating a laser beam and/or a photoelectric beam. Optionally module 124 may further comprise a photoelectric detector and/or laser sensor. Optionally a generated laser beam and/or photoelectric beam may be directional, provided in the direction of aim as determined by the weapon's barrel.

Optionally the directional laser beam and/or photoelectric beam signal may be transmitted and/or communicated to friendly assets forming a part of system 100 that is in the range of the weapon utilized. Optionally and preferably the data communicated may further comprise ammunition data and ballistic data from said controller module 112

Sensor module 130 most preferably provides a plurality of optional sensors that provide further essential navigational, directional and positional information to controller 112. Most preferably sensor module 130 includes a three-axis digital compass 136, a three-axis gyro sensor 132, and a three-axis accelerometer 134. Optionally and preferably sensor module 130 may further comprise barometric pressure sensor 138.

Optionally three-axis digital compass 136 may be realized in the form of a magnetic field sensor.

Preferably the data provided by the sensor module 130 enhances the position, directional data provided by GPS module 118. Optionally and preferably controller 112 provides for merging and determining the navigational and positional data obtained from sensor module 130 and GPS module 118.

Optionally accelerometer sensor 134 and three-axis gyro sensor 132 may provide for enhancing the direction of aim data obtained with RF module 120 and in particular RF narrow beam antenna 122.

Optionally accelerometer sensor 134 and three-axis gyro sensor 132 may provide for enhancing the direction of aim data provided to optics module 124.

Optionally sensor module 130 may further comprise temperature sensor (not shown), luminosity sensor (now shown), digital light sensor (not shown), heart rate sensor (not shown), flow-meter (now shown), pulse oximeter (not shown), piezoelectric pressure sensor (not shown), pressure sensor (not shown), magnetic field sensor, the like or any combination thereof.

Optionally weapons unit 110 may be provided in a housing that is customized to fit with the weapon of choice. Optionally different housing may be provided to accommodate different type of weapons 10. For example, the housing utilized with a weapons unit 110 may be customized according to the weapon associated therewith for example, one housing may be customized to fit with a M16 rifle, while a second housing may be customized to fit with a tank's cannon.

Optionally weapons unit 110 may be provided within a housing that is customized to fit over a portion of an associated weapon for example including but not limited to barrel, gun-sight, scope, handle, hand guard, grip, trigger, any combination thereof or the like.

Figure 3B:
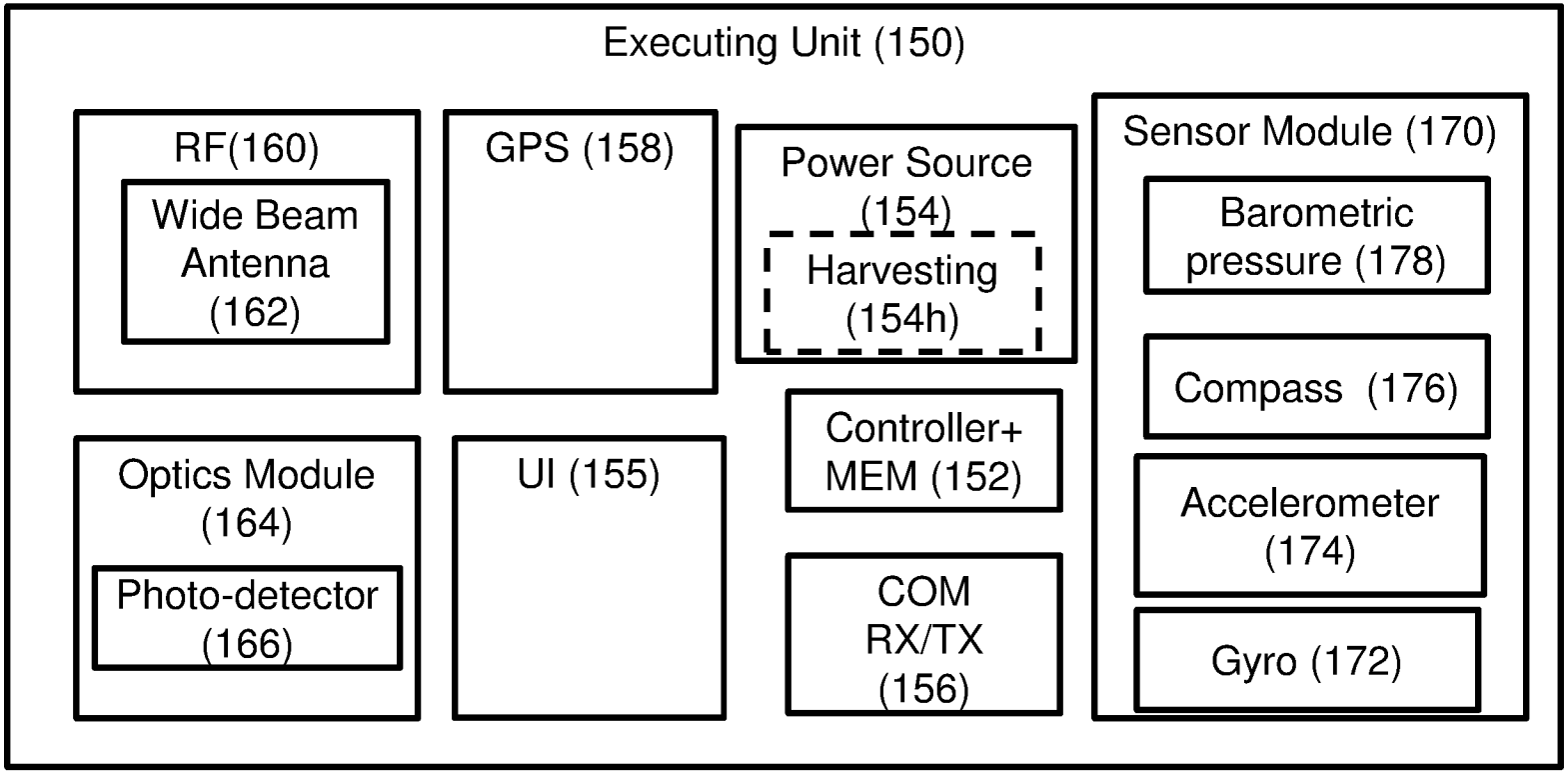
FIG. 3B is a schematic block diagram of an exemplary executing unit device according to an optional embodiment of the present invention.

Now referring to FIG. 3B showing a schematic block diagram of an optional embodiment of a navigation and communication device 200 (FIG. 4) customized to form an executing unit 150. Executing unit 150 may be coupled or otherwise associated with a friendly asset for example including but not limited to an individual, person, soldier, law enforcement office, police officer, robot, animal, battlefront asset, battlefront vehicle or the like. Optionally a battlefront asset and/or vehicle may for example include but not limited to armored vehicles, infantry vehicles, combat vehicles, tanks, naval vessels, warships, submarines, air force vehicles, fighter jets, airplanes, helicopter gunship, unmanned aerial vehicle (UAV), drones, terrestrial robots, airborne robots, marine robots, naval robots or the like. Optionally execution unit 150 associated with a friendly asset is provided to identify the location and direction of motion within the area of interest arena, rather than the direction of aim as provided with the weapons unit 110.

Execution unit 150 comprises a controller and memory module 152, a mobile power supply 154, user interface (UI) module 155, a communication module 156, a GPS module 158, Radio Frequency (RF) module 160, Optics Module 164, and a sensor module 170.

Most preferably the sensor module 170 includes a three-axis digital compass 176, a three-axis gyro sensor 172, and a three-axis accelerometer 174 and a barometric pressure sensor 178.

Optionally three-axis digital compass 176 may be realized in the form of a magnetic field sensor.

Optionally executing unit 150 may be disposed in optional housing based on the friendly asset coupled therewith. For example when executing unit 150 is coupled to a soldier and/or hunter it may be realized within or integrated with an article of clothing for example including but not limited to footwear, headgear, helmet, uniform, parachute, vest, Kevlar vest, army vest, jump suite, flight suite, gloves, or the like. For example, executing unit 150 may optionally be incorporated within the heel of an army boot or the like footwear.

Optionally executing unit 150 may further comprise an optional energy harvesting module **154*h* as part of energy module 154**. Optionally energy harvesting module may be realized in optional forms provided to convert kinetic energy into electric potential energy.

Optionally energy harvesting module **154*h* may for example include but is not limited to a piezoelectric pressure pad, solar cells, any combination thereof or the like. For example, a pressure pad optionally in the form of a piezoelectric pad may be coupled with the heel of an army boot wherein unit 150 is associated, therein allowing the kinetic energy generated with the footwear may be in part converted and/or harvested into electrical potential energy to replenish and/or energize power supply 154**.

Controller and memory module 152 provides for storing and processing data associated with unit 150. Optionally and preferably module 152 provides for ascertaining likelihood and/or probability of friendly fire incident with respect to nearby friendly assets, for example including units 110, 150.

Mobile power supply 154 may optionally be provided in the form of a battery, rechargeable battery, super capacitor, or the like.

Optionally, UI module 155 provides a user with means for interfacing with processor and memory module 152 may be provided in optional forms for example including but not limited to keyboard, display, touch screen, touch pad, buzzer, tactile pad, at least one light emitting diode (LED), at least one organic LED (OLED), speakers, microphone or any combination thereof. Optionally UI module 155 may indicate the risk for friendly fire.

Optionally communication module 156 provides for communicating with other friendly assets forming system 100 and/or an optional administrator 102. Optionally communication module 156 may be realized in the form of a receiver transceiver (Rx/Tx) able to both receive and transmit communication signals. Optionally and preferably communication module 156 is functionally associated with all communication means incorporated with executing unit 150, for example including but not limited to RF module 120, optics module 124, GPS 118 therein preferably providing unit 115 with a plurality of optional forms of communications.

Optionally and preferably GPS module 158 provides a navigation and location device implemented as is known in the art.

Optionally a Radio Frequency (RF) module 160 facilitates RF communications with communication module 156. Most preferably RF module 160 is provided with a wide beam antenna 162 to facilitate generation and transmission of a wide beam RF signal to cover a large area wherein a friendly asset coupled with unit 150 may be identified with a generated wide beam antenna 162. Most preferably the wide beam RF signal is communicated to friendly assets forming part of system 100.

Optics module 164 preferably provides for generating a laser beam and/or a photoelectric beam. Module 164 further comprises a photoelectric detector and/or laser sensor 166. Optionally and preferably photoelectric detector and/or lase sensor 166 may be provided about an article of clothing for example including but not limited to a uniform, helmet, footwear, boot, vest, collar, or the like wearable item.

Preferably the data provided by the sensor module 170 enhances the position, directional data provided by GPS module 158. Optionally and preferably controller 152 provides for merging and determining the navigational and positional data obtained from sensor module 170 and GPS module 158.

Most preferably sensor module 170 provides capability of identifying not only the location of a soldier or the like friendly asset (terrestrial robot), for example as may be provided by GPS module 158, but also the elevation and/or altitude information associated with the friendly asset carrying unit 150. Most preferably altitude and/or elevation data may be processed with processor module 152 by analysis of data provided with at least two or more of barometric sensor 178, three-axis compass 176, three-axis accelerometer 174, three-axis gyro 172 provided in sensor module 170. Preferably the sensor data enhances the GPS data so as to determine the exact location of a soldier particularly when in a location where GPS is not available, for example when the friendly asset associated with unit 150 is inside of a building or similar structure. For example, barometric pressure sensor 178 in combination with a three-axis compass 176 may provide detailed altitude information facilitating the exact location.

Optionally sensor module 170 may further comprise temperature sensor (not shown), luminosity sensor (now shown), digital light sensor (not shown), heart rate sensor (not shown), flow-meter (now shown), pulse oximeter (not shown), piezoelectric pressure sensor (not shown), pressure sensor (not shown), the like or any combination thereof.

Figure 4:
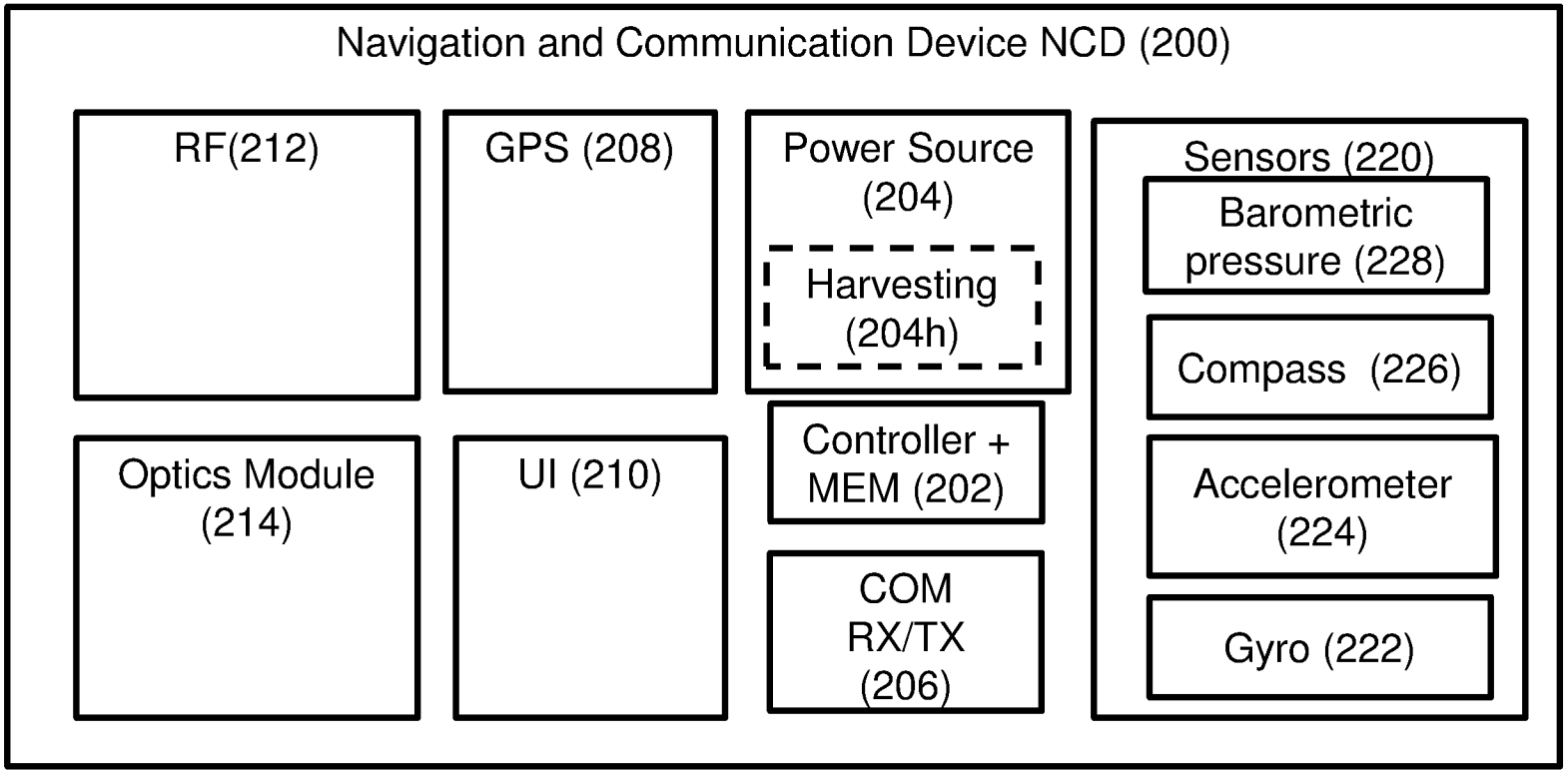
FIG. 4 is a schematic block diagram of an optional device according to an optional embodiment of the present invention.

FIG. 4 shows an optional navigation and communication device 200 according to an optional embodiment of the present invention. Device 200 may utilized to prevent friendly fire in a plurality of optional situations for example including but not limited to warring arena, battle field, military exercise arena, crises area, emergency services, hunting expedition, or the like so as to prevent unintentional friendly fire incidents.

FIG. 1-3 showed specific adaptions of the navigation and communication device 200 that are customized for a weapon therein in rending weapons unit 110, and those that are customized for executing units such as individuals, robots, vehicles, animals whose primary role is to render their weapons functional in the most efficient manner.

Navigation and communication device 200 comprises the functional units and/or modules as previously described; each of such modules may be adapted and/or customized for particular applications. For example, device 200 may be customized for a hunting expedition and be fit with a plurality of hunters and any hunting dogs forming part of the hunting group. Device 200 may be customized for the hunters in that it could be housed within a hunting vest, for example; while the hunting dog may be provided with a customized collar integrated with device 200.

Device 200 comprises a controller and memory module 202, a mobile power supply 204, user interface (UI) module 210, a communication module 206, a GPS module 208, Radio Frequency (RF) module 212, Optics Module 214, and a sensor module 220.

Most preferably the sensor module 220 includes a three-axis digital compass 226, a three-axis gyro sensor 222, and a three-axis accelerometer 224 and a barometric pressure sensor 228.

Optionally three-axis digital compass 226 may be realized in the form of a magnetic field sensor.

Most preferably device 200 is fit with GPS data, elevation and/or altitude data provided by sensor module, as previously described, RF communication and optical communication that may be streamlines and coordinated with communication module.

Optionally RF module may be provided with a plurality of optional antennas to depict the type of single for example including but not limited to a narrow beam and directed antenna as described with weapon unit 110 and a wide beam RF data as provided with unit 150.

Optionally the RF module 212 may comprise at least one or more RF antenna that may for example be selected from at least one or more of narrow beam antenna, wide beam antenna, omnidirectional antenna, directional antenna, polarizing antenna, or any combination thereof.

Similarly optics module 224 may be customized as is needed to provide a photoelectric, laser, electro-optics communication and capabilities.

Optionally power module 204 may be provided with an optional energy harvesting device for example such as solar cell, and/or piezoelectric pad to convert kinetic energy to electric potential energy that may be utilized to power NCD 200.

Controller and memory module 202 preferably integrates and controls device 200 rending it functional and to enable data processing and exchange. Most preferably controller module 202 provides for the formation of a self-organized MESH network 50, 52 previously described.

Optionally and preferably data processing with processing module 202 further provides for ascertaining the likelihood and/or probability for a friendly fire incident based on the MESH network 50, 52 members more particularly based on their location and firing range.

Preferably a first NCD 200 may be in communication with all neighboring NCDs 200 that are in its vicinity; wherein each NCD is capable of mapping the relative location of all neighboring NCDs 200 so as to generate a map ascertaining the likelihood and/or probability of friendly fire incident relative to all neighboring NCD 200. Optionally and preferably all NCD 200 may generate such a probability map by forming a MESH network between all friendly neighboring NCDs.

Figure 5:
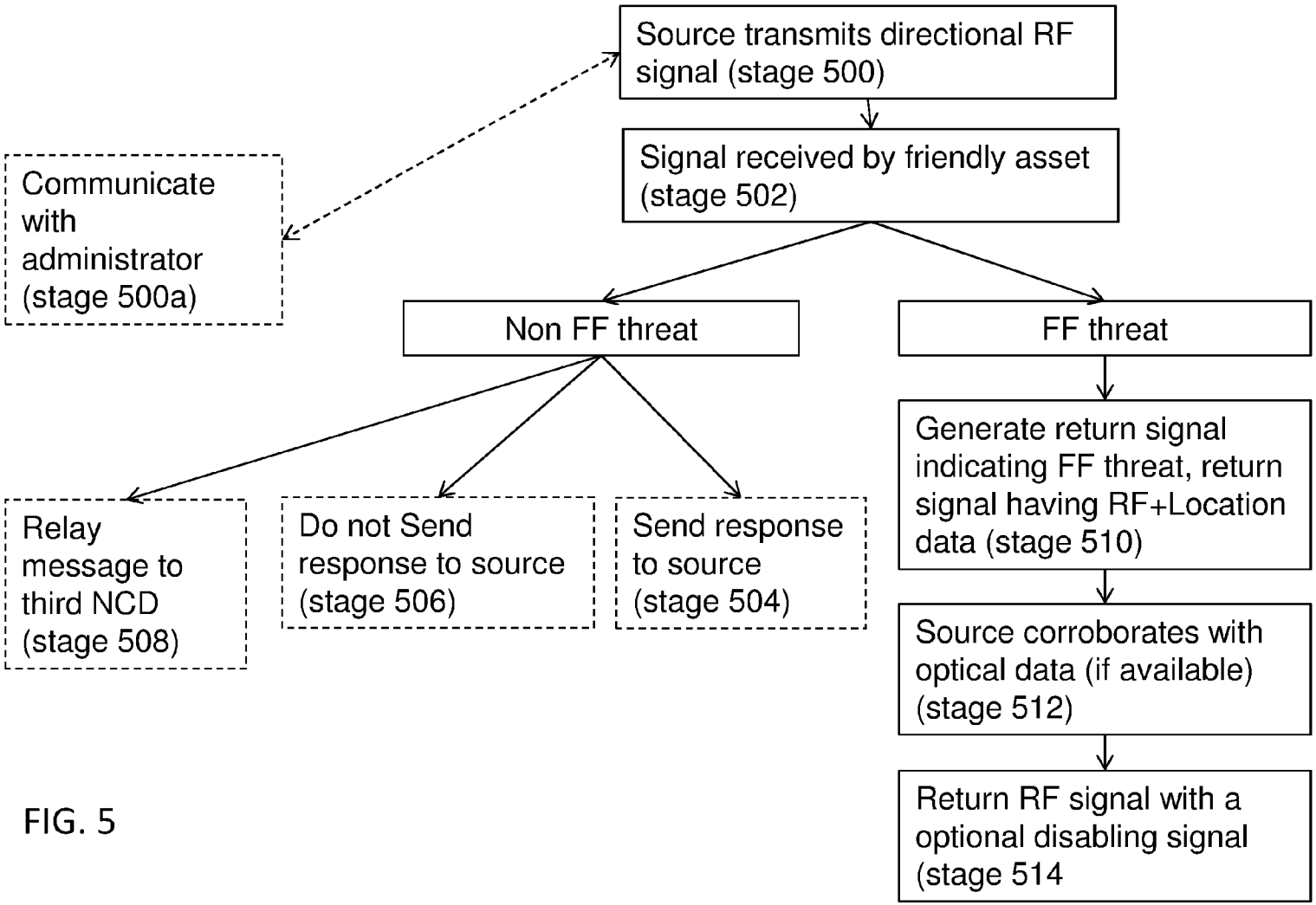
FIG. 5 is a flowchart of an optional method for avoiding friendly fire incidents according to optional embodiments of the present invention.

FIG. 5 shows a flowchart depicting the method for preventing friendly fire between friendly assets utilizing the navigation and communication device (NCD) 200 of the present invention, by way of communication between at least two friendly assets each comprising a navigation and communication device (200, 110, 150) as previously described forming a system 100 that optionally and preferably defines an optional MESH network 50,52.

First in stage 500, NCD data is generated and communicated from a first friendly asset associated with an optional NCD (200, 110, 150). Most preferably NCD data comprises at least NCD location, position and direction of aim. Optionally and preferably NCD data may further comprise ammunition data for example including but not limited to the type of ammunition, ballistics, expected range, trajectory, expected fire power, the like or any combination thereof.

Most preferably the NCD data is generated utilizing its processing module (202, 112, 152), communication module (206, 116, 156), RF module (210, 120, 160), GPS module (208, 118, 158) and sensor module (230, 130, 170), as previously described. Most preferably the NCD Data is communicated utilizing the NCD communication module in a directed manner such that the NCD data is directed based on the direction of aim of any weapon (10) associated with any weapons unit (110).

Optionally NCD data for NCD's in the form of an executing unit 150 comprises ammunition data based on the ammunition available to and associated with unit 150. Optionally NCD ammunition data may for example include but is not limited to ballistics, range and trajectory, the like or any combination thereof. Optionally NCD ammunition data for executing unit 150 may be provided for optional executing assets having an integrated and/or internal ammunition processing unit for determining ammunition range, ballistic data, trajectory or the like. For example, types of executing units 150 that may include an internal ammunition processing unit may for example include but is not limited to tanks (cannon processing unit), helicopter (rockets and guns processing unit), naval gunship (rockets and guns processing unit), combat jet, drone, artillery gun, or the like.

In an optional parallel stage 500*a*, an NCD first navigation and communication device (200,110,150) is in communication with an optional administrator (102), for example as previously described in FIG. 1. Optionally communication with administrator 102 may be performed at any stage with any optional NCD. Optionally, communication between administrator 102 and optional NCD (200, 110,150) may be performed at any point in time, in any manner for example including but not limited to intermittent time based communication wherein communication is established at a given and/or controllable time interval or optionally communication may be continuous.

Next in stage 502 the transmission generated with NCD communication module by first NCD of stage 500 is received by a second NCD, for example via communication module (206, 116, 156). The signal is preferably processed via processing module (202, 112, 152) to determine if a friendly fire threat exists. Optionally the processor determines the probability and/or likelihood of friendly fire based on the NCD data received. Optionally NCD data processing may include any encryption coding and/or decoding and/or modulation and/or demodulation.

Next in stages 504 to 508 depicts optional recourse where in stage 502 wherein NCD processor determines that no threat persists for the particular friendly asset therein advancing to three optional stages 504, 506 and 508. Optionally in stage 504 a response signal may be generated by the second NCD and transmitted to the first NCD indicating the non-threat. Optionally in stage 506 no action is taken and no return communication is initiated by the second NCD. Optionally in stage 508 the second NCD may serve as a relay and relay the data transmitted by the first NCD.

Next in stages 510 to 514 take place where the NCD processor of the second NCD in stage 502 determines that there is a threat to a friendly asset. Next in stage 510 a return RF signal is generated and transmitted, for example with wide beam antenna, by second NCD to the first NCD and optionally to an administrator 102. Most preferably the transmission includes the threat level and/or likelihood and location, and direction of motion. Next in stage 512 the second NCD transmission is received by the first NCD and is processed by the first NCD. Next in stage 512 the location of the second NCD is corroborated by first NCD optionally utilizing optical module (214, 164, 124). Optionally the location of second NCD is confirmed and optionally refined with optional optics module, for example utilizing a laser and photo-detector. Optionally if for any reason any portion of NCD data is not available for example GPS data is not available, then optionally the location data may be replaced with data from the sensor module as previously described. Next in stage 514, if location is confirmed both in RF and Optics optionally a disabling signal may be communicated form the second NCD to the first NCD, to reduce likelihood of a friendly fire incident. Optionally communication between first NCD and second NCD may be facilitated with the UI module.

Optionally and preferably a first NCD and a second NCD maintains communication at least as long as the likelihood and/or probability of friendly fire threat remains valid, for example forming a MESH network as shown and described in FIG. 2A-B.

Figure 6:
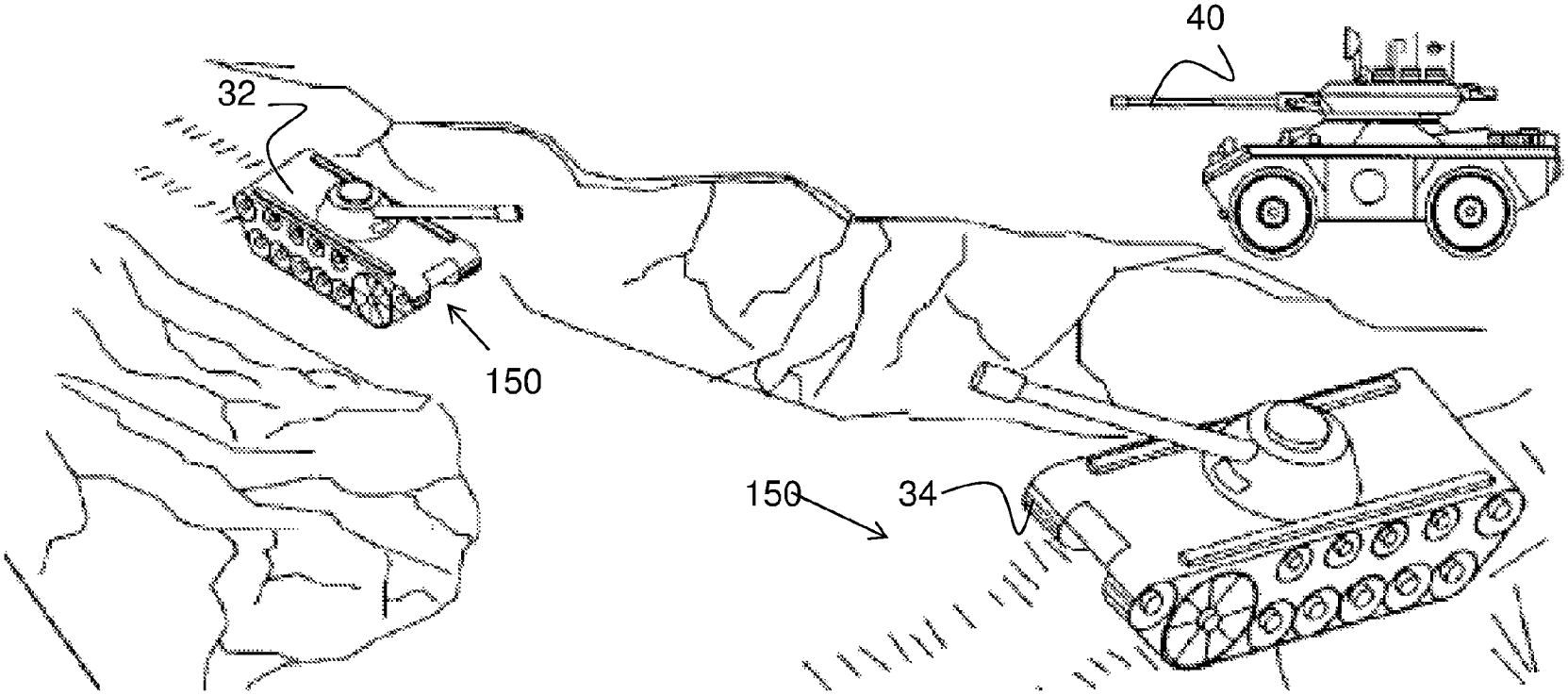
FIG. 6 is a schematic illustrative diagram of a system according to an optional embodiment of the present invention.

FIG. 6 shows a schematic illustration of a warzone including two friendly assets 32, 34 in the form of tanks and a non-friendly asset 40. Most preferably each friendly asset 32 comprises at least NCD according to the present invention for example in the form of executing unit 150, as previously described. Optionally the NCD between tank 32 and tank 34 are in communication via a MESH network 50,52 established as tank 32 takes aim on enemy asset 40. Most preferably the NCD data associated with tank 32, is generated and communicated to tank 34, wherein the individual processing modules of executing unit 150, will determine the relative risk and/or probability of a friendly fire incident. Most preferably the risk and/or probability determined with the respective processing units accounts for the ammunition, projectile, trajectory, cannon's position and ammunition range available in tank 32, utilizing all available navigational data and ammunition data. Most preferably the determination of the relative risk of a friendly fire incident may be directly associated with the ammunition analysis provided in part by the association and/or communication between executing unit 150 with the tank 32 internal ammunition and/or weapon's processor. Therefore processor module of NCD associated with tank 32 and coupled to the tank's internal ammunition and/or weapon's processor may determine that no threat is in place and therefore allow fire on enemy asset 40, optionally the NCD processor module may reach a different conclusion, indicating that there is a risk of a friendly fire incident, for example based on the ammunition data, and therefore optionally by disarming tank 32 until such a time that tank 34 is no longer at risk and non-friendly asset 40 may be fired upon.

Optionally and friendly assets such as tank 32, 34 may maintain communication via its NCD 150 and/or an optional administrator 102 within a MESH network 50, 52 to continuously evaluate the risk of friendly fire between the friendly assets in the firing range.

Figure 7:
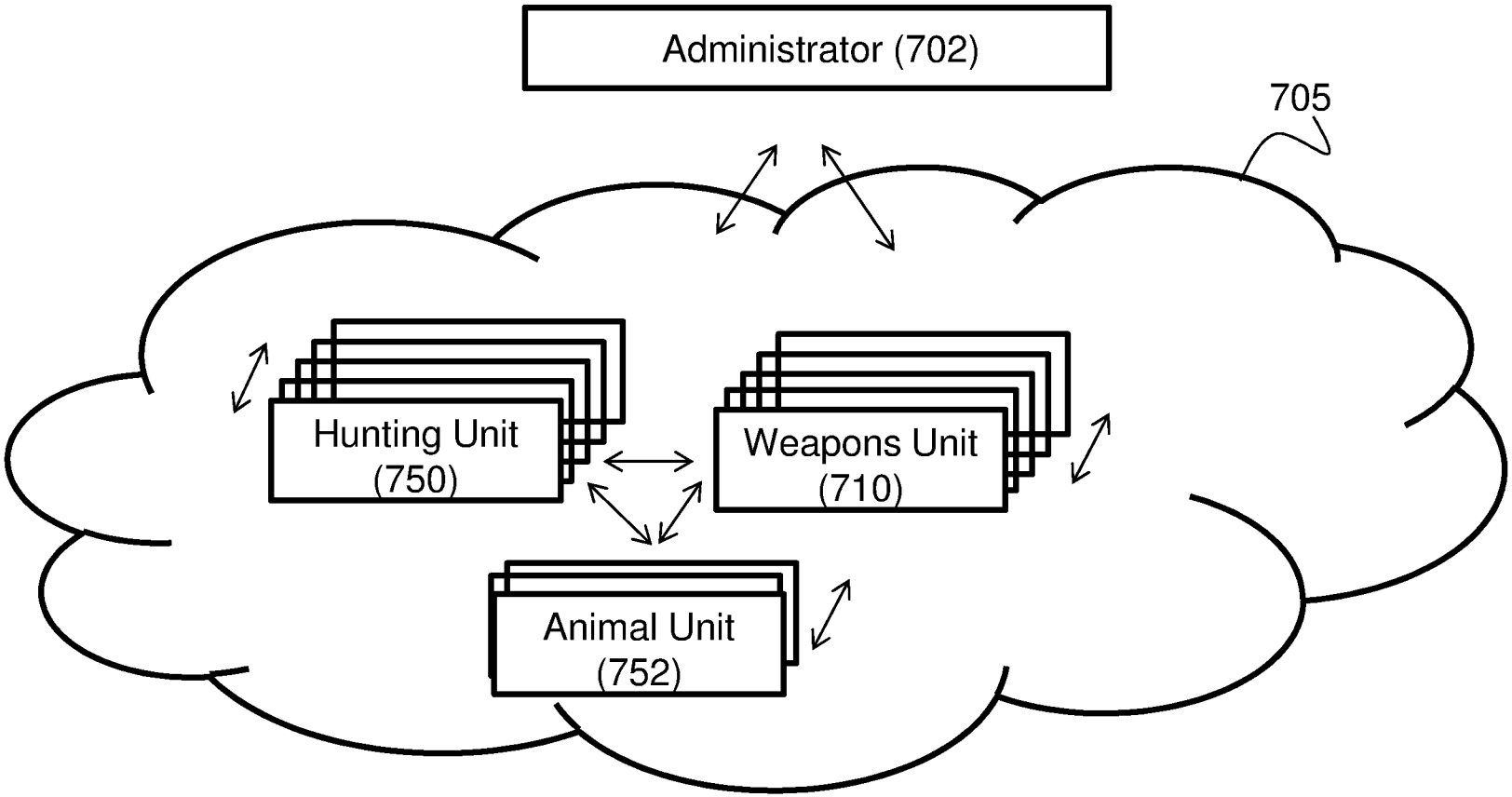
FIG. 7 is a schematic block diagram of an exemplary system according to an optional embodiment of the present invention in a civilian hunting application of the NCD according to optional embodiment of the present invention.

FIG. 7 shows a further civilian implementation of NCD 200 according to the present invention as applied to a hunting setting and/or expedition. Optionally in a hunting system 700 comprises a plurality of specialized NCD 200 that are in communication forming a MESH network 705, that is specific to a civilian application of the NCD for example to govern NCD members utilizing during a hunting expedition and/or a hunting grounds and/or region. Preferably MESH network is provided to evaluate the risk of friendly fire between the hunting party members comprising hunters and optionally an animal aid usually in the form of a dog.

Preferably all hunters within a part are fit with a NCD 200 forming an optional hunting unit 750. Optionally NCD 200 may be incorporated within an article of clothing for example including but not limited to a hunting vest, footwear, headgear, belt, specialized garment, or the like. Optionally hunting unit 750 may be provided as a hand held device that may be associated with the hunter. Optionally and preferably as previously described sensors module 220 facilitates navigation and knowing the location of a NCD 200, particularly when GPS data is not available. The sensor module is particularly important when the hunting grounds are in remote locations for example within a dense forest and/or bush, therein if GPS is not available sensor module 220 provides for navigation and location information utilizing a plurality of sensors as previously described.

Preferably any dog or the like animal facilitating and/or taking part in the hunting party, for example including but not limited to a horse, dog, mule, lama, alpaca, or the like may be fit with a customized NCD 200, as previously described to provide an animal unit 752. Optionally animal unit 752 may be housed in optional forms depending on the animal with which it is used and may for example include but is not limited to a collar, animal vest, or the like article of clothing adapted for specific animal.

Preferably all hunting weapons are fit with a specialized NCD 200 forming a weapons unit 710 similar to weapons unit 110 described in FIG. 1-6. Most preferably weapons unit 710 provide for determining the direction of aim of any firearm, shotgun, rifle or the like, as previously described, taking into consideration all ballistics, trajectory and range information relating to the type of ammunition used. Preferably weapons unit 710 comprises a directional RF antenna that is configured to be positioned parallel to the weapons barrel to provide directionality. Furthermore the sensors module 220 provides data indicative of the direction and the weapon's barrel.

Optionally weapons unit 710 may comprise an RF module 712 comprising both a narrow beam antenna 122, for example as previously described as part of weapons unit 110, and a wide beam antenna 162 for example as previously described as part of execution unit 150.

Preferably, narrow beam antenna 122 may be provided to identify the direction of aim of a firearm, as previously described.

Optionally the RF module 712 may comprise an RF antenna that may for example include but is not limited to at least one or more of narrow beam antenna, wide beam antenna, omnidirectional antenna, directional antenna, polarizing antenna, or any combination thereof.

Optionally and preferably communication between all hunting party members via specialized NCD 200 in the form of weapons unit 710, animal unit 752, hunting unit 750 may be provided via the internal communication module 206 that is an integral part of NCD 200. Optionally communication may be facilitated via an administrator unit 702. Administrator 702 may optionally be provided to oversee all communication and interaction between all NCD's associated with the hunting party so as to prevent a friendly fire incident such that no cross fire between humans, or between human and animal is experienced between members fit with optional forms of NCD 200, for example in the form of weapon's unit 710, or hunting unit 750, animal unit 752.

Optionally

There are many inventions described and illustrated herein. The present inventions are neither limited to any single aspect nor embodiment thereof, nor to any combinations and/or permutations of such aspects and/or embodiments. Moreover, each of the aspects of the present inventions, and/or embodiments thereof, may be employed alone or in combination with one or more of the other aspects of the present inventions and/or embodiments thereof. For the sake of brevity, many of those permutations and combinations will not be discussed separately herein.

While the invention has been described with respect to a limited number of embodiment, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not described to limit the invention to the exact construction and operation shown and described and accordingly, all suitable modifications and equivalents may be resorted to, falling within the scope of the invention.

Having described a specific preferred embodiment of the invention with reference to the accompanying drawings, it will be appreciated that the present invention is not limited to that precise embodiment and that various changes and modifications can be effected therein by one of ordinary skill in the art without departing from the scope or spirit of the invention defined by the appended claims.

While the invention has been described with respect to a limited number of embodiments, it will be appreciated that many variations, modifications and other applications of the invention may be made.

What is claimed is:

1. A friendly fire avoidance system (100), the system comprising a plurality of specialized navigation and communication devices ('NCD') (200) that are wirelessly associated with one another and in communication with one another forming a MESH network (50,52) wherein each NCD (200) forms a member of said MESH network, wherein said NCDs (200) are provided in the form of a weapons unit (110,710) or an executing unit (150,750,752), wherein each of said NCD units include a controller and memory module (112, 152, 202), mobile power supply (114,154,204), communication module (116, 156, 206), GPS module (118, 158, 208), Radio Frequency (RF) module (120, 160, 212), and a sensor module (130, 170, 220), characterized in that said sensor module comprises a three-axis digital compass (226,136,176), three-axis gyro sensor (222,132,172), and a three-axis accelerometer (224,134,174); wherein each controller module (112, 152, 202) controls and integrates the functionality of said weapons units (110) and said executing units (150), and wherein each communication modules (116, 156, 206) provide for transmitting and receiving signals from associated MESH network members (50,52) weapons unit (110) and/or executing unit (150) associated therewith over said MESH network (50,52);

a) wherein said weapons unit (110) is associated with a weapon and/or firearm (10) having a barrel (12) said weapons unit (110) characterized in that said RF module (120) includes a narrow beam antenna (122) or an omnidirectional antenna provided to identify the direction of aim of said firearm (10); and wherein said processor (112) comprises a priori data relating to the weapon (10) associated with weapons unit (110) including associated ammunition, ammunition trajectory, and ammunition range provided for estimating the hit zone specific to the type of weapon and ammunition utilized; and b) wherein said executing unit (150) is associated with at least one of a soldier (20), animal (22), battlefront vehicle (30); said executing unit (150) characterized in that said RF module (160) includes a wide beam antenna (162) or an omnidirectional antenna and wherein said controller (152) comprises a priori data relating to performance of executing unit (150) coupled thereto.

2. The system of claim 1 wherein said narrow beam antenna (122) of said weapons unit (110) is configured to produce a narrow RF signal in the direction of barrel (12).

3. The system of claim 2 wherein said narrow beam antenna (122) of said weapons unit (110) is configured according to the performance characteristics of the barrel (12) attached thereto.

4. The system of claim 2 wherein said narrow beam antenna (122) of said weapons unit (110) is configured according to the weapon (10) attached thereto.

5. The system of claim 1 wherein said narrow beam antenna (122) is coupled to weapon (10) said substantially in parallel with said barrel (12).

6. The system of claim 1 wherein at least one of said NCD units (200,110,150) further comprise an optics module (124, 164, 214).

7. The system of claim 6 wherein said optic module (164) disposed on an executing unit (150) includes a photo-detector (166).

8. The system of claim 7 wherein said photo-detector (166) is positioned parallel to said RF module (160).

9. The system of claim 1 wherein said NCD (200, 110, 150) units selected from weapons unit (110), executing unit (150), are by default in an always on modern.

10. The system of claim 9 wherein said NCD (200, 110,150) is manually deactivated for a preset period of time.

11. The system of claim 9 wherein said NCD (200,110, 150) is manually deactivated for a preset number of times within a given timespan.

12. The system of claim 1 wherein said MESH network (50,52) is a self-organized and/or moving MESH network wherein new members (nodes) are recruited and/or included based on their proximity to an existing member.

13. The system of claim 1 wherein said MESH network is a self-organized and/or moving MESH network wherein new members are recruited and/or included when said new member is in ammunition range and/or a weapon is pointed in the direction of said new member.

14. The system of claim 1 wherein each of the system's controller modules (202,112, 152) define a risk area (50).

15. The system of claim 14 wherein said controller module defines a non-firing zone (56).

16. The system of claim 14 wherein said controllers define a firing safe zone (54).

17. The system of claim 1 wherein at least one NCD (200, 110,150) further comprise a User Interface (UI) module (115, 155,210).

18. The system of claim 17 wherein said UI module (210,115, 155) is selected from the group consisting of keyboard, display, touch screen, touch pad, buzzer, tactile pad, at least one light emitting diode (LED), at least one organic LED (OLED), speakers, microphone or any combination thereof.

19. The system of claim 1 wherein the battlefront vehicle (30) is selected from the group consisting of armored vehicles, infantry vehicles, combat vehicles, tanks, naval vessels, warships, submarines, air force vehicles, fighter jets, airplanes, helicopter gunship, unmanned aerial vehicle (UAV), drones.

20. The system of claim 1 wherein said weapon (10) is a manually triggered firearm of any caliber, for example selected from the group consisting of a hand held gun, gun, pistol, rifle, assault weapon, assault rifle, automatic weapon, semi-automatic weapon, machine gun, RPG, MAG, launcher, grenade launcher, mortar cannon, mortar launcher, cannon, tank cannon, artillery launcher, howitzer.

21. The system of claim 1 further comprising a higher processing center in the form of an administrator (102) provided to oversee management and interaction of said plurality of NCD (200, 110, 150).

22. The system of claim 21 wherein said administrator (102) can remotely control any one or group of said NCD (200).

23. The system of claim 21 wherein said administrator (102) control is configured to shut down or disable at least one or more of NCD (200,110,150).

24. The system of claim 21 wherein said administrator (102) can remotely define and incorporate MESH network members.

25. The system of claim 21 wherein said administrator (102) can remotely define the MESH network members.

26. The system of claim 21 wherein said administrator (102) is provided with master control of all MESH network members in the form of NCD (200, 110, 150).

27. The system of claim 1 wherein said sensor module (220, 130, 170) further comprises a barometric pressure sensor (228,138, 178).

28. The system of claim 1 wherein said weapons unit (110) further comprises a disarming module (140) that is functionally associated with said weapon (10) along its trigger provided to disable firing said weapon (10).

29. The system of claim 28 wherein said disarming module (140) provides for disabling weapon (10) for a preset period of time.

30. A navigation and control device (NCD) (200) including a controller module (202), mobile power supply (204), communication module (206), UI module (210), GPS module (208), Radio Frequency (RF) module (212), Optics Module (214, 164) and a sensor module (220), characterized in that said sensor module (220) comprises a three-axis digital compass (226), three-axis gyro sensor (222), and a three-axis accelerometer (224); and wherein said RF module (212) includes at least two or more antennae having:

i) a narrow beam antennae; and ii) at least one or more antennae selected from the group consisting of: a narrow beam antenna, a wide beam antenna, omnidirectional antenna, directional antenna, polarizing antenna, any combination thereof.

31. The device of claim 30 wherein said sensor module (220) further comprises a barometric pressure sensor (228).

32. The device of claim 30 wherein said user interface module (210) is selected from at least one of a keyboard, display, touch screen, touch pad, buzzer, tactile pad, at least one light emitting diode (LED), at least one organic LED (OLED), speakers, microphone or any combination thereof.

33. The device of claim 30 configured to be a hand held mobile device.

34. A friendly fire avoidance system (100), the system comprising a plurality of specialized navigation and communication devices ('NCD') (200) according to claim 30, wherein the NCD (200) devices are wirelessly associated with one another and in communication with one another forming a MESH network (50,52,) wherein each NCD (200) forms a member of said MESH network.

35. A method for the prevention of friendly fire incidents between friendly assets by utilizing a system comprising a plurality of navigational and controlling device (NCD) (200, 110, 150), wherein said navigation and control device (NCD) (200) include: a controller module (202), a mobile power supply (204), a communication module (206), a UI module (210), a GPS module (208), a Radio Frequency (RF) module (212), an optics module (214, 164) and a sensor module (220), characterized in that said sensor module (220) comprises a three-axis digital compass (226), three-axis gyro sensor (222), and a three-axis accelerometer (224);

wherein each friendly asset is associated with at least one NCD device (200, 110, 150) and wherein said plurality of NCD devices are in wireless communication with one another forming a MESH network wherein each NCD defines a network member or node, the method characterized in that each NCD device (200,110,150) is configured to generate and communicate a directional data set including at least one of: NCD device location, position, direction of aim, direction of motion;

wherein said directional data set is communicated to neighboring NCD devices in a directional manner based on the direction of aim of any weapon (10) associated with the NCD (200,110) and/or based on the direction of motion of any friendly asset (32,34) associated with the NCD (200, 150);

wherein all NCD receiving said directional data set analyze the directional data to determine if a friendly fire threat exists, said analysis provided to determine the probability and/or likelihood of friendly fire between any network members, wherein said analysis is preferably processed with a processing module (202, 112, 152) of each of said network members; and wherein any detected probability and/or likelihood of friendly fire incident based on said directional data set, generates a return signal data set warning of said friendly fire probability;

wherein said return signal data set is communicated to at least the NCD device network member giving rise the friendly fire threat.

36. The method of claim 35 wherein the generated data set further comprises ammunition data selected from at least one or more of type of ammunition, ballistics, expected range, trajectory, expected fire power, any combination thereof.

37. The method of claim 36 wherein said data set is communicated in a directional manner that is further based on said ammunition data.

38. The method of claim 35 wherein said friendly fire probability and/or likelihood is communicated to all network members.

39. The method of claim 35 wherein all network members generate a return signal in response to all directional data set that is received, regardless of the determined friendly fire probability.

40. The method of claim 35 wherein communicated data between said network members is communicated in a secure manner.

41. The method of claim 35 wherein communication between network members is selected from direct communication or indirect (relayed) communication.

42. The method of claim 35 wherein said return signal and said directional data set are RF signals generated with at least one antenna disposed in said RF module.

43. The method of claim 35 wherein said return signal comprises the threat level and/or likelihood and location, and direction of motion; device location, position and direction of aim, direction of motion.

44. The method of claim 35 wherein the location of neighboring NCD devices is further corroborated utilizing an optical signal generated by a optics module (214, 164, 124) utilizing a laser and photo-detector; allowing a network member to corroborate friendly asset location based both on RF data and Optics data.

45. The method of claim 35 wherein a network member communicates a weapon's disabling signal is communicated to the relevant network members to reduce likelihood of a friendly fire incident.

46. The method of claim 35 wherein said network further comprises a network administrator (102) provided to oversee communication between all network member NCD devices.

* * * * *